US005865115A

United States Patent [19]

Fassler et al.

[11] Patent Number: 5,865,115

[45] Date of Patent: Feb. 2, 1999

[54] USING ELECTRO-OSMOSIS FOR RE-INKING A MOVEABLE BELT

[75] Inventors: Werner Fassler, Rochester; Charles D. DeBoer, Palmyra; James E. Pickering, Bloomfield, all of N.Y.

[73] Assignee: Eastman Kodak Company, Rochester, N.Y.

[21] Appl. No.: 89,793

[22] Filed: Jun. 3, 1998

[51] Int. Cl.[6] ..... B41L 13/14

[52] U.S. Cl. ..... 101/177; 101/174; 347/213; 347/172

[58] Field of Search ..... 101/177, 174, 101/171; 347/213, 177, 172; 346/140.1

[56] References Cited

U.S. PATENT DOCUMENTS

| | | | |
|---|---|---|---|
| 3,263,606 | 8/1966 | Poynter | 101/177 |
| 4,243,726 | 1/1981 | Lennon et al. | 428/545 |
| 4,315,983 | 2/1982 | Kawamura et al. | 430/70 |
| 4,377,815 | 3/1983 | Henning et al. | 346/140.1 |
| 4,415,621 | 11/1983 | Specht et al. | 428/172 |
| 4,508,811 | 4/1985 | Gravesteijn et al. | 430/270 |
| 4,582,776 | 4/1986 | Matsui et al. | 503/227 |
| 4,656,121 | 4/1987 | Sato et al. | 430/495 |
| 4,661,393 | 4/1987 | Uchiyama et al. | 428/200 |
| 4,833,124 | 5/1989 | Lum | 503/227 |
| 4,912,083 | 3/1990 | Chapman et al. | 503/227 |
| 4,942,141 | 7/1990 | DeBoer et al. | 503/227 |
| 4,948,776 | 8/1990 | Evans et al. | 430/270 |
| 4,948,777 | 8/1990 | Evans et al. | 503/227 |
| 4,948,778 | 8/1990 | DeBoer | 503/227 |
| 4,950,639 | 8/1990 | DeBoer et al. | 503/227 |
| 4,952,552 | 8/1990 | Chapman et al. | 503/227 |
| 5,023,229 | 6/1991 | Evans et al. | 503/227 |
| 5,024,990 | 6/1991 | Chapman et al. | 503/227 |
| 5,043,318 | 8/1991 | Kawakami et al. | 503/227 |
| 5,105,209 | 4/1992 | Koto et al. | 346/140 R |
| 5,118,657 | 6/1992 | Kawakami et al. | 503/227 |
| 5,137,382 | 8/1992 | Miyajima | 400/202.4 |
| 5,156,938 | 10/1992 | Foley et al. | 430/200 |
| 5,263,781 | 11/1993 | Mima et al. | 347/213 |
| 5,286,521 | 2/1994 | Matsuda et al. | 427/146 |
| 5,286,604 | 2/1994 | Simmons | 430/286 |
| 5,290,116 | 3/1994 | Chang | 346/140.1 |
| 5,334,574 | 8/1994 | Matsuda et al. | 503/227 |
| 5,340,699 | 8/1994 | Haley et al. | 430/302 |
| 5,360,694 | 11/1994 | Thien et al. | 430/200 |
| 5,401,607 | 3/1995 | Takiff et al. | 430/253 |

(List continued on next page.)

FOREIGN PATENT DOCUMENTS 568993 10/1993 European Pat. Off. .

OTHER PUBLICATIONS

Matsuoka, M., Infrared Absorbing Dyes, Plenum Press, New York, 1990.

Venkataraman, The Chemistry of Synthetic Dyes; Academic Press, 1970: vols. 1–4.

The Colour Index Society of Dyers and Colourists, Yorkshire, England, vols. 1–8.

Pigment Handbook; Lewis, P.A., Ed.; Wiley, New York, 1988.

*Primary Examiner*—Edgar Burr
*Assistant Examiner*—Anthony H. Nguyen
*Attorney, Agent, or Firm*—Raymond L. Owens

[57] ABSTRACT

Apparatus for color printing on a moveable receiver includes a re-inkable belt including an ink transfer layer where an ink can be transferred; a structure for causing the moveable receiver to move into proximate contact with the re-inkable belt at a nip position for transferring ink imagewise to the moveable receiver; and an interface capillary spaced from the re-inkable belt and for receiving ink and including pumping structure operating on the ink in the interface capillary for forming a meniscus in such space which engages the re-inkable belt so that ink will be diffused into the ink transfer surface. The apparatus further forms a meniscus when the re-inkable belt passes by the interface capillary to cause ink to diffuse into the ink transfer layer when the ink transfer layer is saturated with ink.

4 Claims, 3 Drawing Sheets

U.S. PATENT DOCUMENTS 5,491,046 2/1996 DeBoer et al. ..... 430/302
5,531,617 7/1996 Williams et al. ..... 101/467
5,611,847 3/1997 Guistina et al. ..... 106/20 R
5,679,139 10/1997 McInerney et al. ..... 106/20 D
5,679,141 10/1997 McInerney et al. ..... 503/227
5,679,142 10/1997 McInerney et al. ..... 106/20 D
5,698,018 12/1997 Bishop et al. ..... 106/31.75
5,786,831 7/1998 Fukushima et al. ..... 346/46

USING ELECTRO-OSMOSIS FOR RE-INKING A MOVEABLE BELT

CROSS REFERENCE TO RELATED APPLICATIONS

Reference is made to commonly assigned U.S. patent application Ser. No. 08/704,297, filed Aug. 29, 1996 entitled "Re-Application of Dye to A Dye Donor Element of Thermal Printers" in the name of Daniel J. Harrison et al. The disclosure of this related application is incorporated herein by reference.

FIELD OF THE INVENTION

This invention relates to laser thermal printing, and, more particularly, to laser thermal printing with a donor which is continually refreshed with colorant during the printing process.

BACKGROUND OF THE INVENTION

Color transfer thermal printers use a color donor member that may be a sheet, but usually is in the form of a web advanced from a supply roll to a take-up roll. The color donor member passes between a printhead and a dye receiver member. The thermal printhead comprises a linear array of resistive heat elements. In operation, the resistive heat elements of the printhead are selectively energized in accordance with data from a printhead control circuit. As a result, the image defined by the data from the printhead control circuit is placed on the receiver member.

A significant problem in this technology is that the color donor members used to make the thermal prints are generally intended for single (one time) use. Thus, although the member has at least three times the area of the final print and contains enough colorant to make a solid black image, only a small fraction of the color is ever used.

After printing an image, the color donor cannot be easily reused, although this has been the subject of several patents. The primary reason that inhibits reuse of the color donor is that the color transfer process is very sensitive to the concentration of the colorant in the donor layer. During the first printing operation, color is selectively removed from the layer thus altering its concentration. In subsequent printings, regions of the donor that had been previously imaged have lower transfer efficiency than regions that were not imaged. This results in a ghost image appearing in subsequent prints.

The cost associated with having a single use donor ribbon is large because of the large area of ribbon required, as well as the large excess of colorant coated on the donor member. While this technology is able to produce high quality continuous tone prints, it is desired to provide an approach which has all of the good attributes of thermal color transfer imaging but without the limitations associated with single use donor members.

Some work has been done by others to accomplish similar goals. For example, U.S. Pat. No. 5,286,521 discusses a reusable wax transfer ink donor ribbon. This process is intended to provide a dye donor ribbon that may be used to print more than one page before the ribbon is completely consumed. U.S. Pat. No. 4,661,393 describes a reusable ink ribbon, again for wax transfer printing. U.S. Pat. No. 5,137,382 discloses a printer device capable of re-inking a thermal transfer ribbon. However, again the technology is wax transfer rather than dye transfer. In the device, solid wax is melted and transferred using a roller onto the reusable transfer ribbon. U.S. Pat. No. 5,334,574 describes a reusable dye donor ribbon for thermal dye transfer printing. This reusable ribbon has multiple layers containing dye which limit the diffusion of dye out of the donor sheet. This enables the ribbon to be used to make multiple prints. In addition, the ribbon may be run at a slower speed than the dye receiver sheet, enabling additional utilization. U.S. Pat. No. 5,118,657 describes a multiple use thermal dye transfer ink ribbon. This ribbon has a high concentration dye layer on the bottom and low concentration dye layer on the top. The low concentration dye layer meters or controls dye transfer out of the ribbon. This enables the ribbon to be used multiple times. U.S. Pat. No. 5,043,318 is another example of a thermal dye transfer ribbon that can be used multiple times.

SUMMARY OF THE INVENTION

An object of this invention is to provide a method and apparatus for rapidly re-inking color patches on a reusable belt for thermal color printing with low cost, high uniformity, and without the use of a semi-permeable membrane.

These objects are achieved by apparatus for color printing on a moveable receiver comprising:

a) a re-inkable belt which includes an ink transfer layer where an ink can be transferred;

b) means for causing the moveable receiver to move into proximate contact with the re-inkable belt at a nip position for transferring ink imagewise from the re-inkable belt to the receiver;

c) means defining an interface capillary spaced from the re-inkable belt and for receiving ink and including means operating on the ink in the interface capillary for forming a meniscus in such space which engages the re-inkable belt so that ink will be diffused into the ink transfer surface; and d) means coupled to the meniscus forming means to cause the meniscus to be formed when the re-inkable belt passes by the interface capillary to cause ink to diffuse into the ink transfer layer to saturate the ink transfer layer with ink.

ADVANTAGES

An advantage of this invention is that a re-inkable web can be more effectively used for transferring inks to a receiver producing images that have high resolution and are of continuous tone.

Another advantage of the present invention is that, when using an electro-osmotic pump, the diffusion process can be started and stopped without mechanical motion.

Another advantage is the dye saturation in the delivery capillary is always the same.

Another advantage is there is no "hard" interface for re-inking the re-inkable belt. A hard interface is where solid materials slide against each other, causing abrasion and damage.

A feature of this invention is that the images can be inexpensively produced because the re-inkable belt is re-useable and there are no wasted colorants.

DETAILED DESCRIPTION OF THE INVENTION

Figure 1:
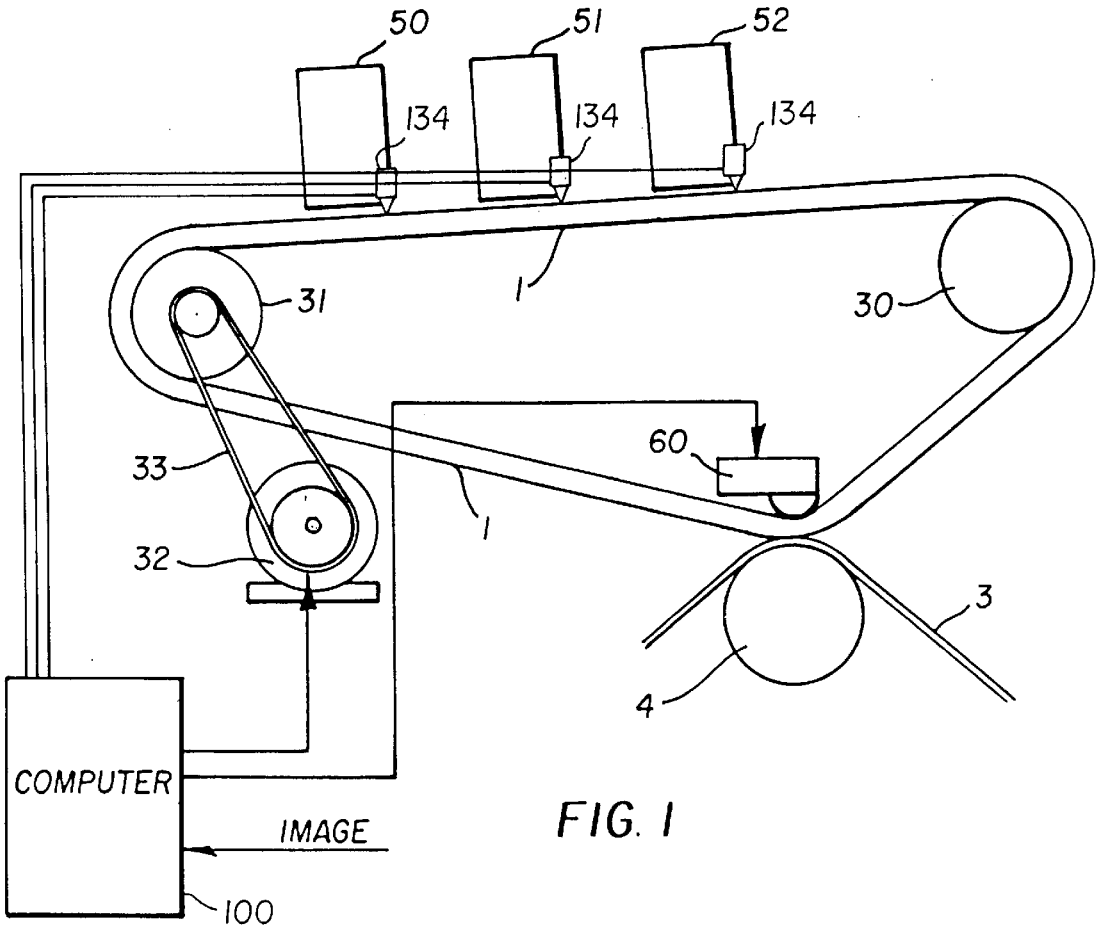
FIG. 1 shows a prior art apparatus depicting a resistive heat printer with a re-inkable web.

Turning to FIG. 1, a resistive heat thermal color printer of the kind described in the above cross referenced patent application is shown where a continuous re-inkable belt 1 replaces the one time use donor ribbon (not shown) generic to all thermal dye transfer printers. It will be understood by those skilled in the art that the term "ink" includes all manner of colorants and stains, including dispersions of pigments in common solvents, or solutions of dyes in such solvents. The solvents used may be water, or may be organic solvents such as alcohols, ketones, esters, ethers, hydrocarbons, and mixtures of the same. Cyan, magenta, and yellow re-ink stations 50, 51, and 52 re-ink the re-inkable belt 1, in patches of cyan, magenta and yellow color. The inks are then transferred by the action of the thermal print head 60 to the moveable receiver 3. The term "ink" as used throughout this specification refers to any colorant such as an ink, dye, or stain, which can be image-wise transferred from the re-inkable belt 1 to the moveable receiver 3. Re-inkable means that colorant, after imagewise usage, can be reapplied to the re-inkable belt 1 belt which is reusable. The re-inkable belt 1 is driven at printing speed with an electric motor 32 which drives the transport rollers 30 and 31 with a speed reduction timing belt 33. The electric motor 32 is controlled by a computer 100, which also controls the timing and power to the thermal print head 60 in accordance with the digital image to be printed. In addition to these control functions, the computer 100 also reads the color patch sensors 134 and the temperature sensors 136, and controls the start times of the re-ink process and the flow rates of the re-ink process in accordance with the temperature sensors 136. Heat generated at the thermal print head 60 migrates through the re-inkable belt 1 to the layer of ink deposited by cyan, magenta and yellow re-ink stations 50, 51, and 52. The heat effects the transfer of color to the moveable receiver 3. During the color transfer, a platen drive roller 4 supports the moveable receiver 3 so that a close contact nip is established between the re-inkable belt 1 and the moveable receiver 3. Those skilled in the art will appreciate that the heat needed for image transfer could also be provided by a radiation source such as a laser.

Figure 2:
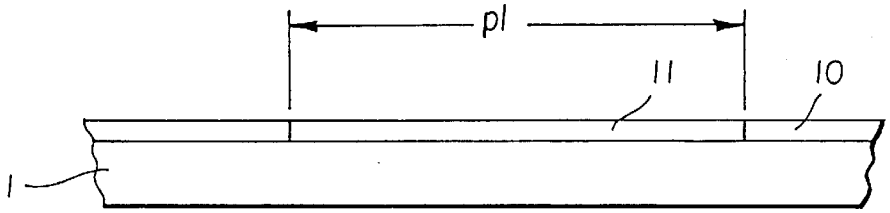
FIG. 2 shows the re-inkable belt of FIG. 1 and illustrates where ink can be diffused into the ink transfer layer.

FIG. 2 shows the re-inkable belt 1 with the ink transfer layer 10 and the colorant patch length "pl" 11 to match image length at a 1:1 ratio. Other ratios can be used. When the ratio of the colorant patch length "pl" to image length is less than 1, the method is commonly called "low donor utilization" because less donor is used for each print.

Figure 3:
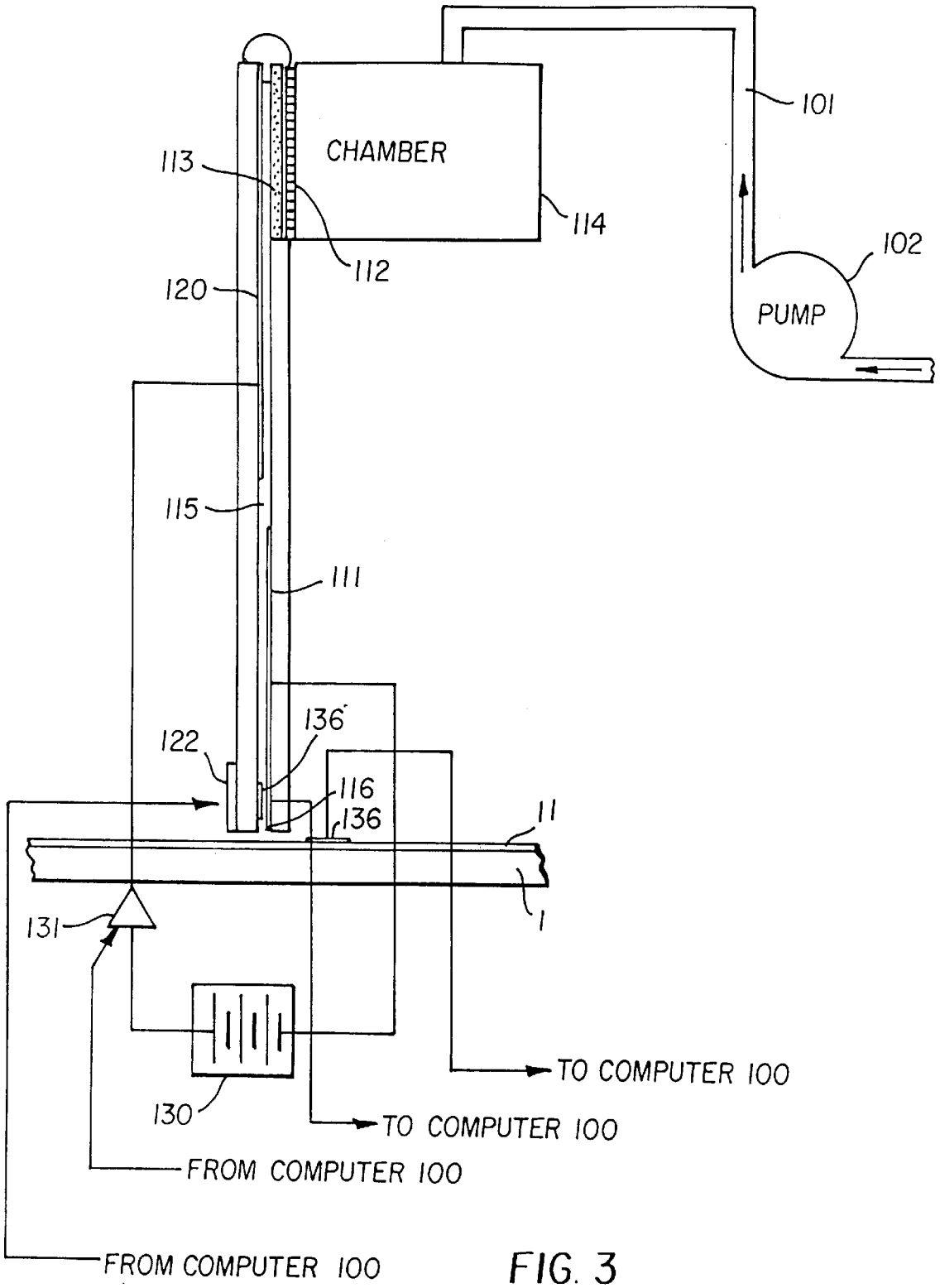
FIG. 3 shows a cross-sectional view of an apparatus for forming a meniscus. No meniscus has been formed in accordance with the present invention, and the colorant is suspended in the plate capillary.

FIG. 3 shows one of the electro-osmosis re-ink stations of this invention, represented in FIG. 1 as 50, 51 and 52. A liquid ink supply is pressurized with pump 102 and delivered through ink supply line 101 into a chamber 114. The chamber 114 with a chamber opening 104 has a circumference seal 103 at the circumference of the open end of two assembled capillary plates 110, and 111. A metal screen 112 and an interface capillary membrane 113, with micron size holes to restrict the ink flow into the capillary plate cavity 115 defined by capillary plates 110 and 111. By "micron size holes" it is implied that the capillary forces of the holes in the interface capillary membrane 113 will balance the capillary force of the capillary plate cavity 115. In practice the size of the holes in the interface capillary membrane 113 will be chosen to correspond to the capillary plate cavity 115. When properly chosen, and when the electro-osmotic force generated by electrodes 120 and 121 is turned off, the capillary interface 116 force on the liquid is less then the capillary force of the interface capillary membrane 113. This pressure difference will enable the device to hold the colorant 13 inside the capillary plate cavity 115, and the re-inkable belt 1 can pass at an interface capillary 116 distance without attracting the colorant 13. The colorant 13 cannot spill onto the re-inkable belt 1 and cause ink blotting. The colorant patch 11 is shown in FIG. 3 approaching the re-inking station 50, 51, and 52. When the color patch sensor 134 detects the correct color at the re-ink station, the computer 100 activates the re-ink process.

Figure 4:
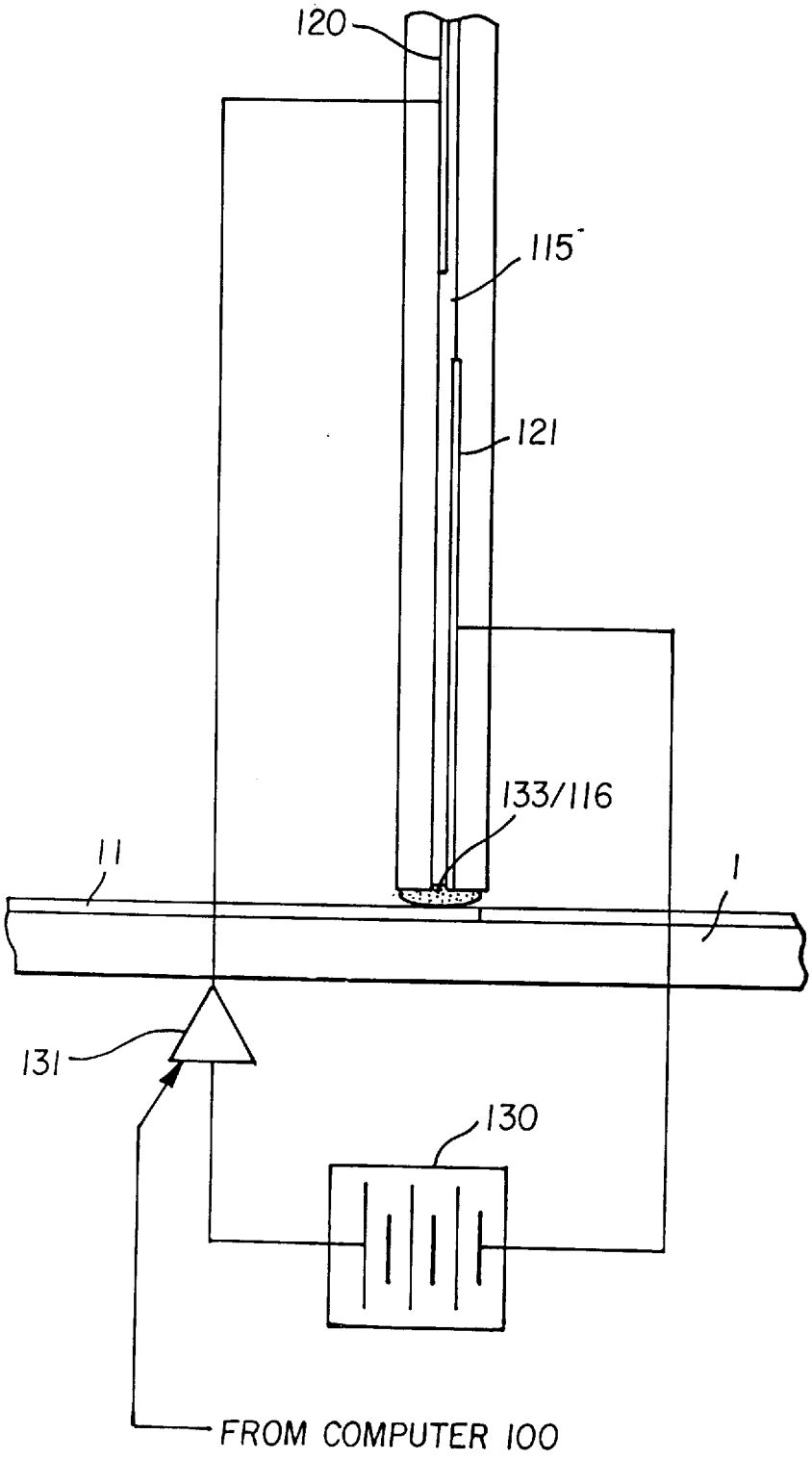
FIG. 4 shows a cross-sectional view of the apparatus of FIG. 3 wherein the electro-osmosis pump has formed the meniscus.

FIG. 4 shows the correct colorant patch 11 under the corresponding cyan, magenta, or yellow re-ink station 50, 51, or 52 shown in FIG. 1 whereupon the computer 100 shown in FIG. 1 turns the power supply 130 on, through transistor 131 to the electro-osmotic electrodes 120 and 121. Immediately a meniscus 133 is formed in the interface capillary 116. The interface capillary 16 holds the liquid meniscus in place and dye can transfer into the ink transfer layer 10 of colorant patch 11 through the process of diffusion. The interface capillary 116 is arranged so that it causes ink to be in an equilibrium condition and spaced from the re-inkable belt. When ink is pumped through the interface capillary membrane 113 it overcomes the equilibrium condition and forms the meniscus 133. The meniscus pressure can be adjusted within limits through voltage variations in electrodes 120 and 121 to compensate for re-inkable belt 1 temperature variations. At the end of the dye diffusive re-inking process the electro-osmosis pump is turned off through the computer 100 in FIG. 1 and the meniscus 133 is pulled back into capillary plate cavity 115. In order to heat the colorant 13 to enhance diffusion colorant transfer, the capillary space can incorporate a heater 122 close to the tip of the two capillary plates 110 and 111. The purpose of the capillary plates 110 and 111 is to form a capillary space between a capillary interface 116 and a capillary membrane 113. The heater 122 is controlled by signals from the computer 100. In order to determine the temperature of both the re-inkable belt 1 and the ink in the chamber 112, temperature sensors 136, are provided. Each of these temperature sensors 136 provide signals to the computer 100 which adjust the heat provided by the heater 122 and the voltage to electrode 120 which along with electrode 121 completes the circuit and adjusts the rate of diffusion of ink into the re-inkable belt 1. This is accomplished by coating and supply electrical power to a resistive material on one of the capillary plates 110 and 111. It will be understood by those skilled in the art that ink in contact with an de-saturated ink receiving layer on the re-inkable belt 1 will acquire a substantial amount of colorant from the source through the process of diffusion. The diffusion rate is proportionate to saturation and will add colorant at the depleted portion of the patch at a faster rate than at a patch portion where the colorant has been slight depleted. At non-depleted (saturated) portions of the patch, the diffusion rate will be in an equilibrium and diffusion in and out of the meniscus will be equal and therefore no dye will be added to the saturated part of the patch 11. It will be understood by those skilled in the art that the approach to saturation is an asymptotic process which never reaches completion. In practice, the approach to saturation need only proceed until ghost image printing is negligible.

When radiant heating is used to form an image, along with the colorants that are added at the re-inking stations 50, 51 and 52 materials should be provided that are non-luminescent absorbers that produce heat by the process known in the art of photochemistry as internal conversion. Such an absorber may be a dye, a pigment, a metal, a metal oxide, or a dichroic stack of materials that absorb radiation by virtue of their refractive indexes and thickness. Dyes are suited for this purpose and may be present in particulate form or preferably substantially in molecular dispersion. Especially preferred are dyes absorbing in the IR region of the spectrum. Examples of such dyes may be found in Matsuoka, M., Infrared Absorbing Materials, Plenum Press, New York, 1990, in Matsuoka, M., Absorption Spectra of Dyes for Diode Lasers, Bunshin Publishing Co., Tokyo, 1990, in U.S. Pat. Nos. 4,833,124 (Lum); 4,912,083 (Chapman et al.); 4,942,141 (DeBoer et al.); 4,948,776 (Evans et al.); 4,948,777 (Evans et al.); 4,948,778 (DeBoer); 4,950,639 (DeBoer); 4,952,552 (Chapman et al.); 5,023,229 (Evans et al.); 5,024,990 (Chapman et al.); 5,286,604 (Simmons); 5,340,699 (Haley et al.); 5,401,607 (Takiff et al.); and in European Patent 568,993 (Yamaoka et al.). Additional dyes are described in Bello, K. A. et al., J Chem. Soc., Chem. Commun, 452 (1993) and U.S. Pat. No. 5,360, 694 (Thien et al.). IR absorbers marketed by American Cyanamid or Glendale Protective Technologies, Inc., Lakeland, Fla., under the designation CYASORB IR-99, IR-126 and IR-165 may also be used, as disclosed in U.S. Pat. No. 5,156,938 (Foley et al.). Further examples may be found in U.S. Pat. Nos. 4,315,983 (Kawamura et al.); 4,415,621 (Specht et al.); 4,508,811 (Gravesteijn et al.); 4,582,776 (Matsui et al.); and 4,656,121 (Sato et al.). In addition to conventional dyes, U.S. Pat. No. 5,351,617 (Williams et al.) describes the use of infrared-absorbing conductive polymers. As will be clear to those skilled in the art, not all the dyes described will be suitable for every construction. Such dyes will be chosen for solubility in, and compatibility with, the specific polymer, sublimable material, and diffusion solvent in question.

In a preferred embodiment of the invention the photothermal conversion layer is coated on the belt 1, as a thin metal layer overcoated with an antireflection layer so that substantially all of the writing radiation will be absorbed and converted into heat. A preferred material is titanium with an optical density of two or more overcoated with an effective quarter wave thickness of titanium dioxide. This combination reduces the reflection of the titanium to less than 10%, while providing absorption of the writing radiation of better than 90%. In addition to providing heat for the transfer of the special color from the donor to the moveable receiver 3, it is important that the photothermal conversion material be chosen so that it does not contaminate the colors that are transferred to the moveable receiver 3. The colorants used in this invention may be dispersions of pigments in common solvents, or solutions of dyes in such solvents. The liquid colorants that feed the cyan, magenta and yellow re-ink stations 50, 51 and 52 of this invention are commonly called inks by those skilled in the art. Examples of such inks may be found in U.S. Pat. No. 5,611,847 by Gustina, Santilli, and Bugner. Inks may also be found in the following commonly assigned U.S. Pat. Nos. 5,679,139 issued Oct. 21, 1997; 5,679,141 issued Oct. 21, 1997; 5,679,142 issued Aug. 20, 1996; and 5,698,018 issued Dec. 16, 1997; and in U.S. patent application Ser. No. 09/034,676 filed Mar. 4, 1998 entitled "Pigmented Inkjet Inks Containing Phosphated Ester Derivatives" by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. Preferred examples of dyes used to make solution inks include those listed in Venkataraman, The Chemistry of Synthetic Dyes; Academic Press, 1970: Vols. 1–4 and The Colour Index Society of Dyers and Colourists, Yorkshire, England, Vols. 1–8. Examples of suitable dyes include cyanine dyes (e.g., streptocyanine, merocyanine, and carbocyanine dyes), squarylium dyes, oxonol dyes, anthraquinone dyes, diradical dicationic dyes, and polycyclic aromatic hydrocarbon dyes. Similarly, pigments can be included within the thermal mass transfer material to impart color and/or fluorescence. Examples are those known for use in the imaging arts including those listed in the Pigment Handbook; Lewis, P. A., Ed.; Wiley, New York, 1988, or available from commercial sources such as Hilton-Davis, Sun Chemical Co., Aldrich Chemical Co., and the Imperial Chemical Industries, Ltd. Heating the color donor layer to thermally transfer color in the method of this invention is accomplished by an thermal resistive heater elements commonly referred to as a thermal head shown as 60 in FIG. 1. An intense light source of short duration may also be used to provide heat. The short exposure minimizes heat loss by conduction and will improve thermal efficiency. U.S. Pat. No. 5,491,046 to DeBoer et al., describes the efficiency improvement with short exposure for a laser thermal process in detail. Suitable light sources include flashlamps and lasers. It is advantageous to employ light sources which are relatively richer in infrared than ultraviolet wavelengths to minimize photochemical effects and maximize thermal efficiency. Therefore, when a laser is used it is preferred that it emit in the infrared or near infrared, especially from about 700 to 1200 nm. Suitable laser sources in this region include Nd:YAG, Nd:YLF and semiconductor lasers. The preferred lasers for use in this invention include high power (>100 mW) single mode laser diodes, fiber-coupled laser diodes, and diode-pumped solid state lasers (e.g. Nd:YAG, and Nd:YLF), and the most preferred lasers are diode lasers which can be directly modulated by changing the electrical currant supplied to the laser. The material chosen for the belt 1 of this invention should be durable, flexible, and capable of uniform re-inking by the colorants. Exemplary materials are thin metal webs such as stainless steel, aluminum and titanium. Polymeric materials may also be employed, provided they are resistant to distortion by high temperature localized heating. An exemplary material is the thermoset polyamide resin Kapton, sold by the DuPont Corporation. Polydimethylsiloxane webs are also useful. To provide rapid dye diffusion into and saturation of the ink transfer layer on the re-inkable belt 1, the ink transfer layer should be composed of a polymer that is rapidly wet and swelled by the solvent of the ink. In addition, the polymeric layer should be crosslinked into a matrix so it will not dissolve in the ink solvent. Exemplary polymers for this purpose are polyvinyl butyral and polyvinyl acetal.

The invention has been described in detail, with particular reference to certain preferred embodiments thereof, but it should be understood that variations and modifications can be effected with the spirit and scope of the invention.

PARTS LIST

1 re-inkable belt
3 moveable receiver
4 platen drive roller
10 ink transfer layer
11 colorant patch
13 colorant

30 transport roller
31 transport roller
32 electric motor
33 speed reduction timing belt
50 cyan re-ink station
51 magenta re-ink station
52 yellow re-ink station
60 thermal print head
100 computer
101 ink supply line
102 pump
103 circumference seal
104 chamber opening
110 capillary plate
111 capillary plate
112 metal screen
113 interface capillary membrane
114 chamber
115 capillary plate cavity
116 interface capillary
120 electrode
121 electrode
122 heater
130 power supply
131 transistor
133 meniscus
134 color patch sensor
136 temperature sensor

What is claimed is:

1. Apparatus for color printing on a moveable receiver comprising:

a) a re-inkable belt which includes an ink transfer layer where an ink can be transferred;

b) means for causing the moveable receiver to move into proximate contact with the re-inkable belt at a nip position for transferring ink imagewise from the re-inkable belt to the receiver; and c) means defining an interface capillary spaced from the re-inkable belt and for receiving ink and including means operating on the ink in the interface capillary for forming a meniscus in such space which engages the re-inkable belt so that ink will be diffused into the ink transfer surface; and d) means coupled to the meniscus forming means to cause the meniscus to be formed when the re-inkable belt passes by the interface capillary to cause ink to diffuse into the ink transfer layer to saturate the ink transfer layer with ink.

2. The apparatus according to claim 1 wherein the meniscus forming means further includes sensor means for determining the temperature of the ink and the re-inkable belt for adjusting heat and pressure to adjust the rate of diffusion of the ink into the re-inkable belt.

3. The invention according to claim 1 wherein the meniscus forming means includes a interface capillary membrane coupled to the interface capillary, the interface capillary being arranged so that it causes ink in the interface capillary to be in an equilibrium condition and spaced from the re-inkable belt; and means for pumping ink through the interface capillary membrane to overcome the equilibrium condition and form the meniscus.

4. Apparatus for forming a multiple colored print on a moveable receiver comprising:

a) a re-inkable belt which includes an ink transfer layer wherein colorants from different patches on the ink transfer layer can be transferred to the moveable receiver to form an image;

b) means for causing the moveable receiver to move into proximate contact with the re-inkable belt at a nip position for transferring ink imagewise from the re-inkable belt to form a colored image;

c) means defining a plurality of interface capillaries spaced from each other and each interface capillary adapted to receive a different colorant, each such interface capillary being spaced from the moveable receiver and including means operating on the ink in the capillaries to form menisci in such spaces which engage the re-inkable belt so that the appropriate colorant will be diffused into the ink transfer surface; and d) means coupled to the menisci forming means to cause each meniscus to be formed when the appropriate patch of the re-inkable belt passes by the interface capillary to cause the appropriate colorant to diffuse into the appropriate patches of the ink transfer layer until each patch in the ink transfer layer is saturated with ink.

* * * * *